US008128520B2

(12) United States Patent
Miner

(10) Patent No.: US 8,128,520 B2
(45) Date of Patent: Mar. 6, 2012

(54) SYSTEMS AND METHODS FOR PROVIDING A TRACKING SYSTEM

(76) Inventor: Kent H. Miner, Lehi, UT (US)

( * ) Notice: Subject to any disclaimer, the term of this patent is extended or adjusted under 35 U.S.C. 154(b) by 509 days.

(21) Appl. No.: 12/248,721

(22) Filed: Oct. 9, 2008

(65) Prior Publication Data

US 2009/0098958 A1 Apr. 16, 2009

Related U.S. Application Data

(60) Provisional application No. 60/978,987, filed on Oct. 10, 2007.

(51) Int. Cl.
*F42B 6/04* (2006.01)

(52) U.S. Cl. ..... 473/578

(58) Field of Classification Search ..... 473/578
See application file for complete search history.

(56) References Cited

U.S. PATENT DOCUMENTS

| | | | |
|---|---|---|---|
| 4,704,612 | A | 11/1987 | Boy et al. |
| 4,976,442 | A | 12/1990 | Treadway |
| 5,450,614 | A | 9/1995 | Rodriguez |
| 6,409,617 | B1 | 6/2002 | Armold |
| 6,469,628 | B1 | 10/2002 | Richards et al. |
| 6,856,250 | B2 | 2/2005 | Hilliard |
| 2003/0132846 | A1 | 7/2003 | Hilliard |
| 2005/0231362 | A1 | 10/2005 | Pridmore, Jr. et al. |
| 2006/0089216 | A1 | 4/2006 | Monteleone |
| 2006/0097882 | A1 | 5/2006 | Brinkerhoff et al. |

FOREIGN PATENT DOCUMENTS

| | | |
|---|---|---|
| WO | WO 99/45761 | 9/1999 |

*Primary Examiner* — John Ricci
(74) *Attorney, Agent, or Firm* — David B. Tingey; Kirton McConkie

(57) ABSTRACT

A tracking system and associated methods for locating animals, such as wounded/downed game animals or non-game animals such as research animals, and/or projectiles configured to be shot at an animal are disclosed. The system includes a transmitter and one or more radio frequency reflectors that are coupled to a projectile. After the projectile is shot, a user utilizes the transmitter to locate the reflector. In some cases, the reflector is integrally coupled to the projectile to allow the user to locate the projectile. In other cases, the reflector is selectively coupled to the projectile so as to be removed from the projectile and attached to the animal when the projectile hits the animal. In such cases, the user may use the transmitter to locate the animal. In still other cases, at least one reflector is integrally coupled to the projectile while another is selectively coupled to the projectile. Accordingly, the user can locate the projectile and the animal.

8 Claims, 3 Drawing Sheets

SYSTEMS AND METHODS FOR PROVIDING A TRACKING SYSTEM

CROSS-REFERENCE TO RELATED APPLICATION

This application claims the benefit of U.S. Provisional Patent Application No. 60/978,987, filed Oct. 10, 2007, the entire disclosure of which is hereby incorporated by reference.

BACKGROUND OF THE INVENTION

1. Field of the Invention

The present invention relates to tracking systems. In particular, the present invention relates to systems and methods for providing a tracking system that enables a user to track and locate an animal, including a wounded or downed animal, and/or a projectile that is configured to be shot at the animal.

2. Background and Related Art

Hunters currently utilize a variety of devices and ammunitions to hunt game animals. For instance, hunters may use a bow and arrow, a cross bow and bolt, a gun and bullet, or other hunting devices in an attempt to kill a game animal. After shooting the animal, the hunter typically desires to find and harvest the animal. Similarly, where the hunter shoots reusable ammunition, such as an arrow or bolt, the hunter may desire to retrieve the ammunition for future use.

There are several conventional methods for finding a wounded/downed game animal and reusable ammunition. For example, when the hunter downs the animal or watches the ammunition fall within the hunter's line of sight, the hunter may easily find the animal/ammunition by looking in the location where the hunter saw the animal/ammunition fall. However, where the hunter does not see the exact location of where the animal/ammunition fell or in instances where the animal is wounded but mobile, the hunter may have a harder time locating the animal/ammunition. In such instances, the hunter may need to perform a broader search in the general vicinity of where animal/ammunition may have fallen. In another example of a method for tracking a wounded animal, the hunter may be able to follow the animal's blood trail to locate the animal. However, because the amount of blood may depend on the severity and location of the wound, the animal's blood trail can often become so faint that the hunter cannot track the wounded animal.

Thus, while techniques currently exist that are used to track wounded game animals and/or reusable ammunition, challenges still exist. Accordingly, it would be an improvement in the art to augment or even replace current techniques with other techniques.

SUMMARY OF THE INVENTION

The present invention relates to tracking systems. In particular, the present invention relates to systems and methods for providing a tracking system that enables a user to track and locate an animal, including a wounded or downed game animal or a non-game animal such as a research animal, and/or a projectile that is configured to be shot at the animal.

Implementation of the present invention takes place in association with a tracking system. Generally, the system includes one or more radio frequency ("RF") reflectors, which are configured to be coupled to an arrow, and a transmitter, which is capable of sending an RF signal to and receiving an RF signal from the RF reflector(s). In some cases and unlike some prior art devices, the RF reflector does not comprise a power source to transmit a radio signal. Instead, in such cases, the RF reflector comprises a passive or a semi-passive RF reflector that includes means for reflecting (or backscattering) RF energy emitted by the transmitter. The transmitter is capable of indicating the strength of the reflected signal in a manner that directs the user towards the reflector. Accordingly, the transmitter can guide the user to the reflector or an object to which the reflector is attached.

In one implementation, the RF reflector is integrally coupled to the arrow so as to remain attached to the arrow after the arrow strikes an object (e.g., a game animal or non-game animal such as a research animal). Thus, the user can utilize the transmitter to locate the arrow and/or an animal in which the arrow is lodged. In another implementation, the RF reflector is selectively and removably coupled to the arrow so as to become uncoupled from the arrow and attached to a game or non-game animal when the arrow impacts the animal. For instance, the RF reflector may be coupled with a barb that is configured to lodge within an animal and become uncoupled from the arrow if the arrow becomes dislodged from the animal. According, through the use of the transmitter, the user can locate the animal, even if the arrow becomes lost. In still another implementation, multiple RF reflectors are coupled to an arrow. In one example, a first RF reflector is selectively coupled to the arrow so as to uncouple from the arrow and attach to the animal (e.g., via a barb) on impact, while a second RF reflector remains coupled to the arrow. The use of multiple RF reflectors in this manner allows the user to utilize the transmitter to locate the animal and the arrow, even if the arrow becomes dislodged from the animal.

In some instances where more than one RF reflector is coupled to an arrow or more than one arrow with an RF reflector is used, each RF reflector may reflect a different signal which the transmitter can distinguish. In this manner, the user can distinguish between different RF reflectors (e.g., a reflector that is integrally coupled to an arrow vs. a reflector that is selectively coupled to the arrow) and, thereby, decide which RF reflector to search for first.

While the systems and methods of the present invention have proven to be particularly useful when implemented with an arrow, those skilled in the art can appreciate that the described systems and methods can be used in association with a variety of projectiles, such as bullets, cross-bow bolts, darts, harpoons, or other hunting projectiles to yield a tracking system that enables the user to track and locate an animal, such as a wounded or downed game animal or a non-game animal such as a research animal, and/or the projectile that is configured to be shot at the animal.

Additionally, while the described systems and methods are well suited for hunting and hunters, the skilled artisan would recognize that the systems and methods may be used in any suitable application and by any suitable user, including for research conducted by researchers on game or non-game animals.

These and other features and advantages of the present systems and methods will be set forth or will become more fully apparent in the description that follows and in the appended claims. The features and advantages may be realized and obtained by means of the instruments and combinations particularly pointed out in the appended claims. Furthermore, the features and advantages of the described systems and methods may be learned by the practice of the systems and methods or will be obvious from the description, as set forth hereinafter.

BRIEF DESCRIPTION OF THE DRAWINGS

In order that the manner in which the above recited and other features and advantages of the described systems and methods are obtained, a more particular description of the systems and methods will be rendered by reference to specific embodiments thereof, which are illustrated in the appended drawings. Understanding that the drawings depict only typical embodiments and are not, therefore, to be considered as limiting in scope, the tracking systems and associated methods will be described and explained with additional specificity and detail through the use of the accompanying drawings in which.

DETAILED DESCRIPTION OF THE INVENTION

The present invention relates to tracking systems. In particular, the present invention relates to systems and methods for providing a tracking system that enables a user (e.g., a hunter) to track and locate an animal (e.g., a wounded or downed game animal or a non-game animal such as a research animal) and/or a projectile that is configured to be shot at the animal.

Figure 1:
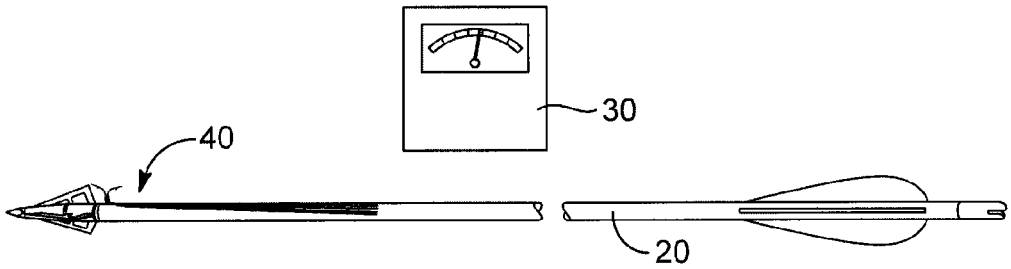
FIG. 1 illustrates a representative embodiment of a tracking system for determining the location of an animal and/or a projectile that is configured to be shot at the animal.

FIG. 1 shows that, in accordance with at least some embodiments, the described tracking system 10 includes a projectile 20 that is configured to be shot at an animal, a transmitter 30, and one or more RF reflectors 40 that are coupled to the projectile 20. Generally, once the projectile has been shot, the user utilizes the transmitter to emit a RF signal, which may be reflected back to the transmitter, to enable the user determine the position of the reflector and anything connected thereto (e.g., an animal and/or the projectile). To provide a better understanding of the tracking system, each of its aforementioned components is discussed below in more detail.

In general, the tracking system can be used with any projectile that is configured to be shot at a game animal so as to wound and/or down the animal, or shot at a non-game animal to be able to track the animal for research purposes. Some non-limiting examples of suitable projectiles include any suitable type of arrow, bolt, dart, harpoon, spear, bullet (i.e., an expandable bullet), or other object that is capable of both being shot at an animal and having the RF reflector coupled to it. For instance, FIG. 1 shows a representative embodiment in which the projectile 20 comprises an arrow.

The tracking system can also be used with any RF transmitter that is capable of sending an RF signal to and receiving an RF signal from an RF reflector in a manner that allows the transmitter to indicate the reflector's location. For example, the transmitter may comprise a hand-held device, a GPS device, a cell phone device, or any electronic device capable of sending and/or receiving a signal. By way of illustration, FIG. 1 shows some embodiments in which the transmitter 40 comprises a hand-held, battery-powered RF transmitter.

The RF transmitter can have any characteristic that allows it to perform its intended function. For example, the transmitter may emit any RF that is suitable for use in the described system. Indeed, in some embodiments, the transmitter emits one or more low frequency signals selected from a range between about 30 and about 200 kHz. However, other embodiments embrace utilization of other frequency ranges, including for example below 30 kHz or above 200 kHz.

The transmitter may be capable of sending an RF signal to and receiving an RF signal from the RF reflector when the reflector is disposed at a variety of distances from the transmitter. In one example, the transmitter is capable of sending signal to and receiving signal from the RF reflector when the reflector is less than about 400 meters from the transmitter. For instance, where the transmitter is capable of detecting the signal from the reflector at less than 400 meters the transmitter is capable of detecting signal from the reflector at a distance selected from at least 5 meters, at least 30 meters, at least 70 meters, at least 100, and at least 150 meters.

In some embodiments, the transmitter is capable of varying the frequency and/or amplitude of the RF signal it emits, depending on the distance of the RF reflector from the transmitter. In one example, the transmitter produces a short range signal when the user or the transmitter determines that the RF reflector is close to the transmitter, In another example, the transmitter produces a long range RF signal when the transmitter or the user determines that the reflector is far from the transmitter.

In some embodiments, the transmitter is also capable of differentiating between different RF reflectors. In such embodiments, the transmitter may distinguish between two or more RF reflectors in any suitable manner, including by determining the difference in signal strength or signal frequency that is reflected by each reflector. In one example, the transmitter is configured to identify which RF reflector closest. In another example, the transmitter is configured to distinguish two or more reflectors, despite their proximity to the transmitter. For instance, where multiple hunters are using arrows with RF reflectors, the transmitter may indicate which arrow belongs to each hunter.

The transmitter may alert the user of the direction and/or proximity to the RF reflector in any suitable manner. For example, the transmitter may produce an audible sound that changes (e.g., changes tone, gets louder or softer, increases or decreases in frequency, pronounces words, etc.) as the transmitter gets closer to or farther from the RF reflector (e.g., as the signal from the RF reflector becomes stronger or weaker). In another example, the transmitter may produce a visual signal (e.g., lights, bars, arrows, movement of a meter on a scaled display, text, etc.) that changes with the intensity of the signal reflected from the RF reflector.

Figure 2:
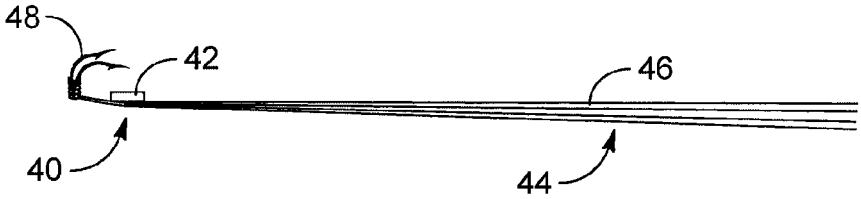
FIG. 2 illustrates a representative embodiment of an RF reflector.

With respect to the RF reflector, the reflector may comprise any RF identification tag, chip, or microchip that is suitable for use with the projectile and capable of being located by the RF transmitter. For example, the RF reflector can comprise an RF identification tag with or without an integrated circuit (e.g., a chipless RF reflector). By way of illustration, FIG. 2 shows a representative embodiment in which the RF reflector 40 comprises an RF identification microchip 42. Where the RF reflector comprises a microchip, the reflector may be any suitable size. By way of example, in one embodiment the microchip has a length of about 0.4 millimeters ("mm") and a width of about 0.4. In some embodiments, the microchip has a length of about 0.4 mm to 12 mm and a width of about 0.4 mm to about 50 mm.

Unlike active RF identification tags that require a power source to power an integrated circuit and to broadcast a response to the RF transmitter, in some embodiments, the RF reflector comprises a semi-passive or passive RF reflector. As used herein, the term semi-passive RF reflector may be defined as an RF reflector that comprises a power source that provides power to an integrated circuit but does not provide power for the broadcasting of an RF signal. Similarly, the term passive RF reflector may be used herein to refer to an RF reflector that is free from an integrated power source, which powers an integrated circuit or the broadcasting of a signal. Because passive RF reflectors are free from an integrated power source, such reflectors can be lighter, smaller, more durable, less expensive, and/or have a longer life than RF identification tags that have a power source (e.g., active or semi-passive RF identification tags). Accordingly, in some embodiments, the RF reflector comprises a passive RF reflector.

The RF reflector can have any characteristic or component that allows it to be detected by the transmitter and coupled to the projectile (e.g., an arrow) without undesirably affecting the projectile's performance. In one example, the RF reflector comprises means for reflecting (e.g., backscattering) energy emitted from the transmitter. The means for reflecting energy emitted from the transmitter may comprise any component that allows the RF reflector to reflect enough of the energy from the transmitter to allow the transmitter to determine the location of the reflector at a distance of less than about 400 meters but more than a distance selected from about 5 meters, about 30 meters, about 70 meters, about 100 meters, and about 150 meters.

Some non-limiting examples of suitable reflecting means include an RF reflective microchip and an antenna. Where the reflecting means comprises an antenna, the antenna may comprise any antenna suitable for use with the projectile and capable of reflecting energy from the transmitter in the described manner. For instance, the antenna may include one or more coils traces, elongated wires, metallic sheets, graphite, printed circuits, and/or other structures and/or materials that are capable of reflecting an RF signal emitted by the transmitter. Additionally, the antenna may be configured in any suitable manner, including being substantially straight, bent, meandered, etc. By way of illustration, FIG. 2 shows a representative embodiment in which the antenna 44 comprises a plurality of elongated wires 46. Where the RF reflector comprises an antenna, the antenna may be electrically connected to the reflector in any suitable manner. For example the antenna and reflector may be melted together, soldered together, joined with an electrically conductive epoxy, connected by plugs/other mechanical connections, or otherwise be connected.

In another example of a suitable reflector characteristic, each RF reflector is optionally configured to reflect a different RF signal than at least one other RF reflector. Thus, as previously mentioned, where the transmitter is capable of distinguishing between the multiple RF signals, the user a user can choose to track one RF reflector over another.

In another example of a suitable RF reflector component, the reflector is optionally coupled to a means for attaching it to an animal. Some non-liming examples of such attaching means comprise one or more barbs, hooks, clips, adhesive materials, and/or other devices capable of attaching the RF reflector to the animal when the projectile carrying the reflector impacts the animal. By way of illustration, FIG. 2 shows a representative embodiment in which the attaching means comprises a barb 48. Where the attaching means comprises one or more barbs, the barbs may have any suitable characteristic, configuration, or orientation. By way of example, the barbs can be oriented to extend from the projectile at any angle (e.g., between about 0 and about 180 degrees from the side of the projectile) that allows the barbs to attach to the animal upon or after impact. For instance, the barbs may extend towards and/or away from an arrow's head. Indeed, in instances where barbs both extend towards and away from the arrow's head, the barbs can become lodged in the animal when the arrow moves into and out of the animal.

Figure 3A:
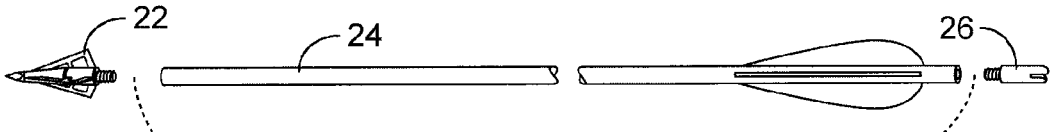
FIG. 3A illustrates an exploded view of a representative embodiment of a projectile to which the RF reflector can be coupled.
Figure 3C:
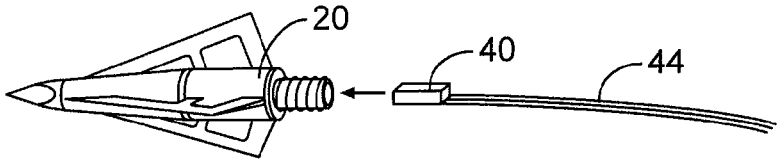
Figure 3D:
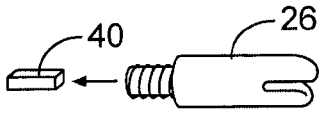
Figure 4:
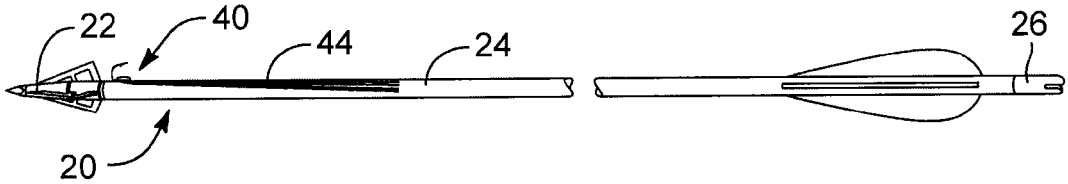
FIG. 4 illustrates a representative embodiment of the projectile with the RF reflector coupled thereto.

The RF reflector may be disposed at any suitable location on the projectile. For example, where the projectile comprises an arrow 20, as shown in FIG. 3A, the RF reflector 40 may be disposed inside and/or outside the arrow's head 22, shaft 24, nock 26, and/or other suitable component. By way of illustration, FIG. 3C shows an embodiment in which the reflector 40 is configured to be disposed within the arrow's head 22. Similarly, FIG. 3D shows an embodiment in which the reflector 40 is configured to be disposed within the arrow's nock 26. In another illustration, FIG. 4 shows a representative embodiment of an arrow 20 in which the RF reflector 40 is disposed on the shaft 24, near the arrow's head 22. Additionally, FIG. 4 shows the antenna 44 extends distally from the RF reflector 40, down a portion of the length of the shaft 24. In still another example, which is not shown, the RF reflector and antenna (if included) are disposed within a hollow portion of the shaft.

The RF reflector may be coupled to the projectile in any suitable manner. For example, one or more RF reflectors can be integrally coupled and/or be selectively and removably coupled to the projectile. Where the RF reflector is integrally coupled to the projectile, the reflector is configured to stay coupled to the projectile after the projectile impacts an animal—even if the projectile becomes dislodged from the animal. In contrast, where the RF reflector is selectively and removably coupled to the projectile, the reflector is configured to be able to be removed from the projectile after the projectile strikes a game animal.

Figure 5:
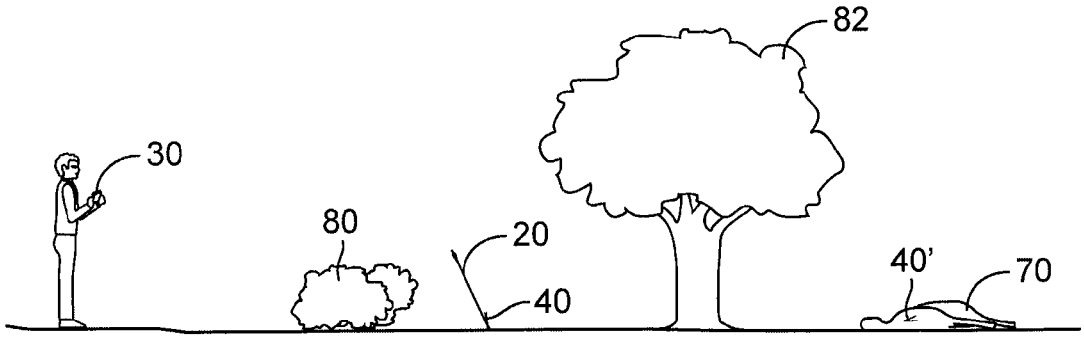
FIG. 5 illustrates a representative embodiment of a method for locating the projectile and an animal.

Thus, where the RF reflector is integrally coupled to the projectile or a portion thereof, the user may use the transmitter to track the projectile or anything attached to it (e.g., a wounded game animal or non-game animal such as a research animal). However, where the RF reflector is selectively and removably coupled to the projectile and capable of attaching to an animal after impact, the user may utilize the transmitter to track the RF reflector and animal—even if the reflector has become separated from the projectile. Similarly, FIG. 5 illustrates that where the an arrow 20 comprises both an RF reflector 40 that is integrally coupled to the arrow 20 and an RF reflector 40' that is selectively and removably coupled to the arrow 20, the user 60 can utilize the transmitter 30 to locate the arrow 20 and the removable RF reflector 40' that is lodged in the animal 70—even when the arrow 20 and animal 70 are occluded from plain view by objects such a bush 80 and a tree 82.

Where the RF reflector is integrally formed with or coupled to the projectile, the reflector may be connected to the projectile in any suitable manner. For instance, the RF reflector may be mechanically, chemically (e.g., an epoxy or glue), or otherwise integrally coupled to the projectile. In one example, the RF reflector and antenna are glued within the interior of an arrow's shaft.

Figure 3B:
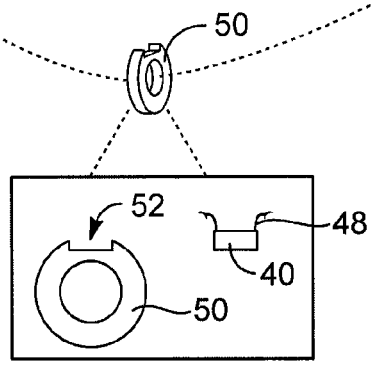
FIG. 3B illustrates a representative embodiment of a washer that connects the RF reflector to the projectile of FIG. 3A.

In another example, FIG. 3B shows a representative embodiment in which a washer 50 is configured to hold the RF reflector 40. Such a washer may offer several advantages, including providing a lightweight, substantially well balanced, in expensive, and/or simple device for attaching the reflector to the projectile. For instance, FIGS. 3A and 3B show the washer 50 can be inserted between the arrow's shaft 24 and head 22 as well as between the arrow's shaft 24 and nock 26.

While such a washer can hold the RF reflector in any suitable manner, FIG. 3B shows an example in which the washer comprises a notch 52 that is sized to receive the RF reflector 40 or a housing comprising the RF reflector. In this example, washer may have any suitable characteristic. For instance, the washer optionally has a diameter that is substantially equal to or smaller than the diameter of the arrow's shaft. Additionally, the washer can accommodate components of the reflector in any suitable manner. For instance, the washer optionally is configured to allow one or more barbs or antennas that are connected to the RF reflector to extend from the washer.

Where the RF reflector is selectively and removably coupled with the projectile, the reflector may be connected to the projectile in a variety of manners. For example, the RF reflector may be selectively coupled to the projectile through the use of an adhesive, a hook-and-loop fastener, a releasable clamp, a frictional engagement, or another releasable coupling means. By way of illustration, FIG. 4 shows a representative embodiment in which at least one RF reflector 40 (i.e., the barb and/or antenna) is adhesively attached to the arrow 20. Thus, when the barb 48 is attached to an animal, the RF reflector 40 may peel or otherwise be released from the arrow 20. In another non-limiting example, where the RF reflector is disposed within a washer, the reflector may be slidably disposed in the washer so as to be selectively released when a pulling force is applied to the reflector.

The various components of the described tracking systems may be manufactured in any suitable manner. In one example, the projectile (e.g., an arrow) is manufactured to comprise one or more RF reflectors. In another example, the projectile and RF reflectors are manufactured separately. Accordingly, in this example the user or another person can modify new or existing projectiles by coupling one or more RF reflectors to the projectiles in a desired manner.

Figure 6:
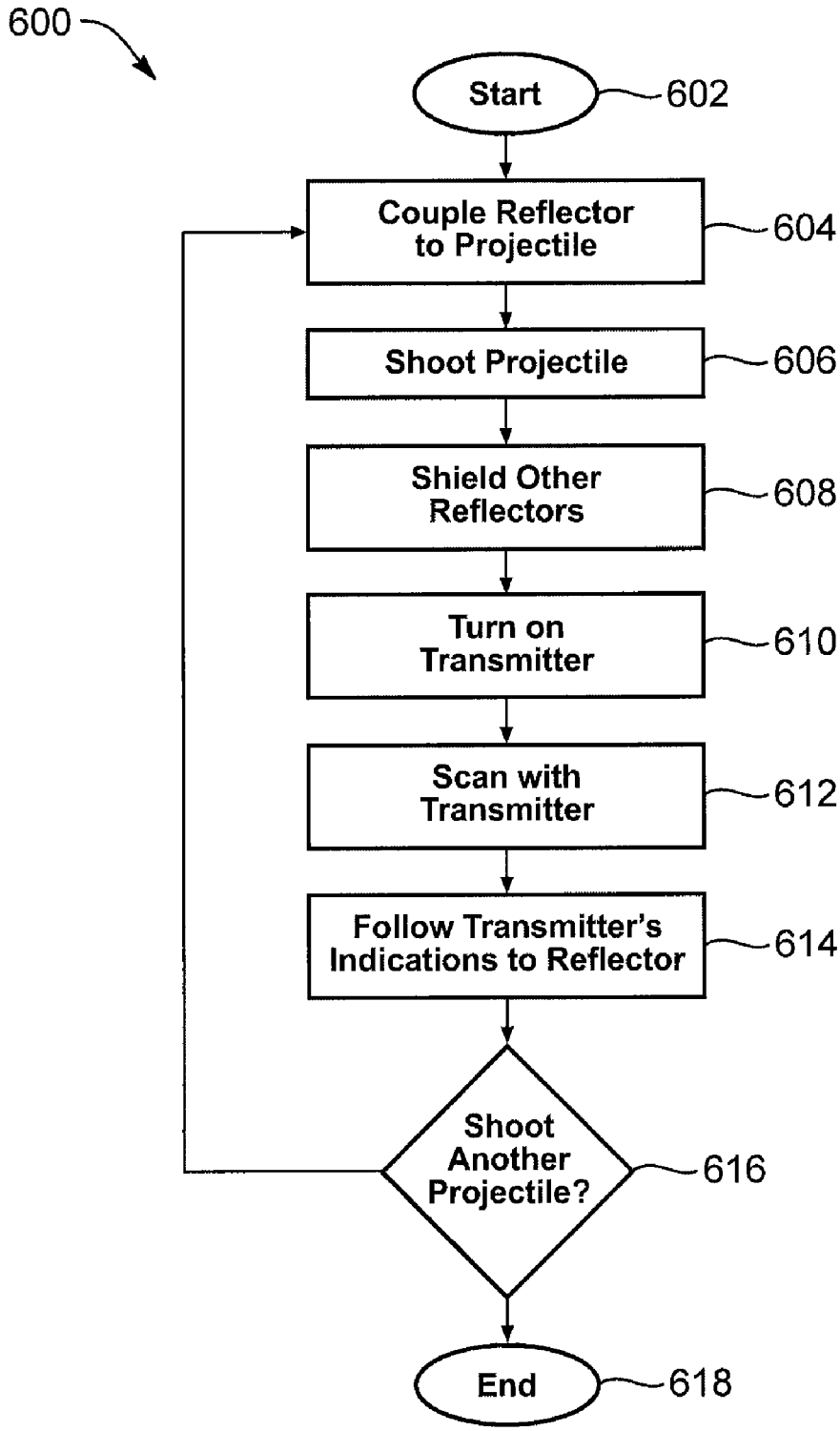
FIG. 6 illustrates a flow chart of a representative method for using the tracking system.

The described tracking system may be used in any suitable manner. By way of example, FIG. 6 illustrates a typical method for using the system. Of course, the skilled artisan will recognize that the method may be varied in any suitable manner.

Specifically, FIG. 6 shows that after the method 600 begins at 602, the method 600 may continue at 604 by coupling an RF reflector to a projectile, such as an arrow. At 606 the user shoots the projectile at a desired object, such as a game or non-game animal. Then, before using the transmitter to locate the RF reflector, FIG. 6 at 608 shows the user shields other RF reflectors (e.g., other arrows with RF reflectors) from the transmitter. For instance, the user may place the other RF reflectors in a metallic object, such as a box or bag, which prevents the RF reflectors from reflecting the transmitter's signal.

With the other RF reflectors shielded from the transmitter, box 610 shows the method continues as the user turns on the transmitter. At this point the transmitter may be automatically or manually set to a short or long range setting. The user can then proceed to scan a desired area for the RF reflector that was shot with the projectile. This scanning process may be done in any suitable manner. For example, where the transmitter is a hand-held device, the user may hold the transmitter substantially parallel with the ground's surface and move the transmitter from side to side in an ark motion. As the user moves the transmitter from side to side, the user may also rotate the transmitter clockwise and counter clockwise in an attempt to better receive signal that is reflected from the reflector. Once the transmitter receives signal from the reflector, box 614 shows the user follows the transmitter's directions (e.g., audio, visual, etc.) to determine the reflector's location. Then, at box 616, the user may choose to repeat the method or end the method at 618.

Accordingly, as discussed herein, the embodiments of the present invention embrace tracking systems. In particular, embodiments of the present invention relate to systems and methods for providing a tracking system that enables a user, such as a hunter, to track and locate an animal, such as a wounded or downed game animal or a non-game animal such as a research animal, and/or the projectile that was shot at the animal.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A radio frequency reflector, comprising:

a radio frequency reflector configured to reflect a signal to a transmitter;

means for backscattering radio frequency energy from the transmitter; and means for attaching the reflector to an animal, wherein the radio frequency reflector comprises means for selectively and removably coupling the reflector with a projectile configured to be shot at the animal.

2. The reflector of claim 1, wherein the backscattering means comprises an antenna that is electrically connected to the reflector.

3. The reflector of claim 1, wherein the coupling means comprises an adhesive.

4. The reflector of claim 1, wherein the coupling means comprises a washer configured to receive the radio frequency reflector.

5. The reflector of claim 1, wherein the reflector comprises a passive radio frequency identification reflector.

6. The reflector of claim 1, wherein the antenna comprises a plurality of wires configured to extend laterally along a shaft of the projectile.

7. The reflector of claim 1, wherein the projectile is selected from:

a. an arrow;

b. a bullet;

c. a cross-bow bolt;

d. a dart; and e. a harpoon.

8. The reflector of claim 1, wherein the reflector is capable of reflecting a different radio frequency signal than at least one other radio frequency reflector.

* * * * *